US011130608B2

(12) United States Patent
Nakayama

(10) Patent No.: US 11,130,608 B2
(45) Date of Patent: Sep. 28, 2021

(54) SQUARE BOTTLE

(71) Applicant: YOSHINO KOGYOSHO CO., LTD., Tokyo (JP)

(72) Inventor: Tadayori Nakayama, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 49 days.

(21) Appl. No.: 16/711,699

(22) Filed: Dec. 12, 2019

(65) Prior Publication Data

US 2020/0189784 A1 Jun. 18, 2020

(30) Foreign Application Priority Data

Dec. 18, 2018 (JP) ..... JP2018-236416

(51) Int. Cl.
*B65D 1/42* (2006.01)
*B65D 1/02* (2006.01)
*B65D 79/00* (2006.01)

(52) U.S. Cl.
CPC ..... *B65D 1/42* (2013.01); *B65D 1/0223* (2013.01); *B65D 1/0276* (2013.01); *B65D 79/0084* (2020.05); *B65D 2501/0036* (2013.01); *B65D 2501/0081* (2013.01)

(58) Field of Classification Search
CPC .... B65D 2501/0081; B65D 2501/0036; B65D 1/42; B65D 1/0223
See application file for complete search history.

(56) References Cited

U.S. PATENT DOCUMENTS 7,451,886 B2 * 11/2008 Lisch ..... B65D 1/0276 215/371
2003/0010743 A1 * 1/2003 Boukobza ..... B65D 1/0223 215/382
2005/0045645 A1 * 3/2005 Tsutsui ..... B65D 79/005 220/669
2006/0054587 A1 * 3/2006 Oguchi ..... B65D 79/005 215/381
2006/0108317 A1 * 5/2006 Tanaka ..... B65D 1/0223 215/382
2010/0163515 A1 * 7/2010 Nemoto ..... B65D 1/0284 215/382
2011/0186538 A1 * 8/2011 Strasser ..... B65D 1/0223 215/381

FOREIGN PATENT DOCUMENTS

JP 5453669 B2 3/2014

* cited by examiner

*Primary Examiner* — James N Smalley
*Assistant Examiner* — Jennifer Castriotta
(74) *Attorney, Agent, or Firm* — Oliff PLC

(57) ABSTRACT

A peripheral groove is defined by a bottom surface, an upper side surface, and a lower side surface, and, in at least one of the upper side surface and the lower side surface, a radially outer end edge of an end portion positioned at a circumferential end portion of a panel surface portion is further away in a bottle axis direction from the bottom surface toward an adjacent corner surface portion when viewed from the outside in the radial direction.

6 Claims, 4 Drawing Sheets

SQUARE BOTTLE

CROSS-REFERENCE TO RELATED APPLICATION

Priority is claimed on Japanese Patent Application No. 2018-236416, filed Dec. 18, 2018, the content of which is incorporated herein by reference.

BACKGROUND OF THE INVENTION

Field of the Invention

The present invention relates to a square bottle.

Description of Related Art

Conventionally, a square bottle including a mouth portion, a shoulder portion, a body portion, and a bottom portion provided to be continuous in this order from a top to a bottom in a bottle axis direction, in which the body portion is configured such that a plurality of panel surface portions are provided to be continuous with corner surface portions therebetween in a circumferential direction around the bottle axis, and peripheral grooves are formed in the body portion is known as described in, for example, Japanese Patent No. 5453669.

In a conventional square bottle, there has been a possibility that a body portion may be improperly deformed, for example, from substantially a square shape or substantially a rectangular shape to a flat shape such as a rhombus in a cross-sectional view at the time of pressure reduction in the square bottle after heat filling.

The present invention has been made in consideration of such circumstances, and an objective of the present invention is to provide a square bottle in which an improper deformation of a body portion can be inhibited at the time of pressure reduction in the square bottle after heat filling.

SUMMARY OF THE INVENTION

In order to solve the above-described problems and achieve the objective, a square bottle according to a first aspect of the present invention includes a mouth portion, a shoulder portion, a body portion, and a bottom portion which are provided to be continuous in this order from a top to a bottom in a bottle axis direction, in which a plurality of panel surface portions are provided in the body portion to be continuous with corner surface portions therebetween in a circumferential direction around a bottle axis and a peripheral groove is formed in the body portion, the peripheral groove is defined by a bottom surface facing outward in a radial direction, an upper side surface extending upward from an upper end of the bottom surface outward in the radial direction, and a lower side surface extending downward from a lower end of the bottom surface outward in the radial direction, and in at least one of the upper side surface and the lower side surface, a radially outer end edge of a portion positioned at a circumferential end portion of each of the plurality of panel surface portions is further away in the bottle axis direction from the bottom surface toward each adjacent corner surface portion when viewed from the outside in the radial direction.

According to the square bottle according to the first aspect of the present invention, in at least one of the upper side surface and the lower side surface in the peripheral groove, a radially outer end edge of a portion (hereinafter referred to as an end portion) positioned at a circumferential end portion of each of the plurality of panel surface portions is further away in a bottle axis direction from the bottom surface toward each adjacent corner surface portion when viewed from the outside in the radial direction, and thereby a surface area of the peripheral groove at a portion positioned at the circumferential end portion of each of the plurality of panel surface portions is extended in the bottle axis direction.

Accordingly, even when a stress applied to a ridge line portion between each of the plurality of panel surface portions and each corner surface portion, on which a stress is particularly easily concentrated, is transferred to the peripheral groove at the time of pressure reduction in the square bottle, the stress is alleviated by an end portion of at least one of the upper side surface and the lower side surface. Therefore, improper deformation of the body portion can be inhibited.

In a square bottle according to a second aspect of the present invention, in the square bottle according to the first aspect, the bottom surface may have a shape that is formed such that a linear portion positioned on each of the plurality of panel surface portions and extending linearly and a curved portion positioned in each corner surface portion and having a convex curved shape outward in the radial direction are alternately provided to be continuous in the circumferential direction in a cross-sectional view perpendicular to the bottle axis, and both circumferential end portions of the curved portion may be positioned to protrude toward each of the plurality of panel surface portions adjacent to each corner surface portion having the curved portion positioned therein on both sides in the circumferential direction.

According to the square bottle according to the second aspect of the present invention, since both the circumferential end portions of the curved portion of the bottom surface are positioned to protrude toward each of the plurality of panel surface portions adjacent to each corner surface portion having the curved portion positioned therein on both sides in the circumferential direction, the circumferential position of the curved portion of the bottom surface and the circumferential position of the ridge line portion overlap each other. Thereby, even when a stress applied to the ridge line portion is transferred from an outer side in the bottle axis direction to the bottom surface of the peripheral groove at the time of pressure reduction in the square bottle, the stress is alleviated by the curved portion. Therefore, improper deformation of the body portion can be reliably inhibited.

In a square bottle according to a third aspect of the present invention, in the square bottle according to the second aspect, in at least one of the upper side surface and the lower side surface, a radially outer end edge of a portion positioned at the circumferential end portion of each of the plurality of panel surface portions may be further away in the bottle axis direction from the bottom surface toward each adjacent corner surface portion from a circumferential position at which a connection portion between the linear portion and the curved portion is positioned when viewed from the outside in the radial direction.

According to the square bottle according to the third aspect of the present invention, since a radially outer end edge of at least one of the end portions of the upper side surface and the lower side surface in the peripheral groove is further away in the bottle axis direction from the bottom surface toward each adjacent corner surface portion from the circumferential position at which the connection portion of the bottom surface is positioned when viewed from the outside in the radial direction, the portion of the peripheral groove positioned at the circumferential end portion of each of the plurality of panel surface portions is defined by the end portions of the upper side surface and the lower side surface, and the curved portion of the bottom surface.

Therefore, a stress transferred from the ridge line portion at the time of pressure reduction in the square bottle can be alleviated in almost the entire region of the portion of the peripheral groove positioned at the circumferential end portion of each of the plurality of panel surface portions, and thereby improper deformation of the body portion can be reliably inhibited.

In a square bottle according to a fourth aspect of the present invention, in the square bottle according to any one of the first to third aspects, each corner surface portion may be formed in a strip shape having a width in the circumferential direction and a length in the bottle axis direction, and, in at least one of the upper side surface and the lower side surface, a radially outer end edge of a portion positioned in each corner surface portion may have a convex curved shape protruding in the bottle axis direction toward the bottom surface to reduce a groove width of the peripheral groove when viewed from the outside in the radial direction.

According to the square bottle according to the fourth aspect of the present invention, since a radially outer end edge of a portion (hereinafter referred to as a corner portion) positioned in each corner surface portion in at least one of the upper side surface and the lower side surface in the peripheral groove has a convex curved shape protruding in the bottle axis direction toward the bottom surface when viewed from the outside in the radial direction, the radially outer end edges of the corner portion and the end portion can be smoothly connected in the circumferential direction. Therefore, a stress can be inhibited from being concentrated on the connection portion between the ridge line portion and the peripheral groove at the time of pressure reduction in the square bottle.

In a square bottle according to a fifth aspect of the present invention, in the square bottle according to any one of the first to fourth aspects, a bottom wall portion of the bottom portion may include an annular ground contact portion positioned at an outer circumferential edge portion, a cylindrical upright circumferential wall portion which is continuous with the ground contact portion from a radially inward side and extends upward, and an annular movable wall portion extending radially inward from an upper end portion of the upright circumferential wall portion and provided to be movable upward about a connection portion with the upright circumferential wall portion.

According to the square bottle according to the fifth aspect of the present invention, since the bottom wall portion of the bottom portion includes the upright circumferential wall portion and the movable wall portion, the movable wall portion is moved upward about the connection portion with the upright circumferential wall portion such that a decrease in internal pressure of the square bottle can be inhibited at the time of pressure reduction in the square bottle. Therefore, improper deformation of the body portion can be reliably inhibited.

According to the present invention, improper deformation of the body portion can be inhibited at the time of pressure reduction in the square bottle after heat filling.

DETAILED DESCRIPTION OF THE INVENTION

Hereinafter, a square bottle 1 according to a first embodiment of the present invention will be described with reference to the drawings.

Figure 1:
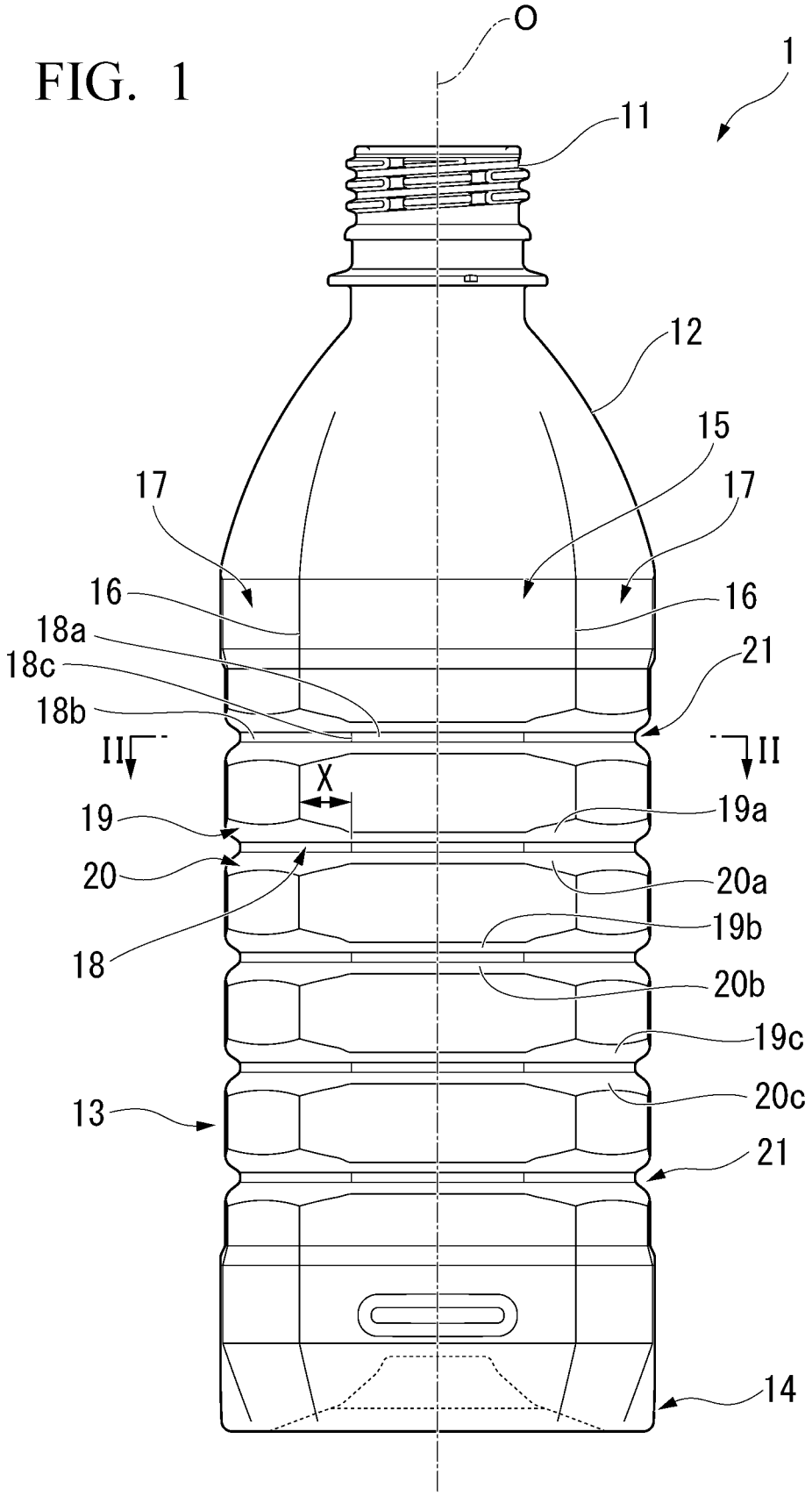
FIG. 1 is a side view of a square bottle shown as a first embodiment according to the present invention when a panel surface portion is seen from the front.

As shown in FIG. 1, the square bottle 1 is configured such that a mouth portion 11, a shoulder portion 12, a body portion 13, and a bottom portion 14 are provided to be continuous in this order from the top to the bottom in a bottle axis O direction.

Hereinafter, when viewed from a vertical direction, a direction intersecting the bottle axis O is referred to as a radial direction, and a direction of revolving around the bottle axis O is referred to as a circumferential direction.

The square bottle 1 is formed by blow-molding a preform formed into a bottomed cylindrical shape by injection molding, and is integrally formed of, for example, a synthetic resin material such as polyethylene terephthalate, polypropylene, and the like. A cap (not shown) is mounted on the mouth portion 11.

An internal volume of the square bottle 1 has a size such that, for example, 200 ml or more and 4000 ml or less of contents can be filled thereinto.

Figure 2:
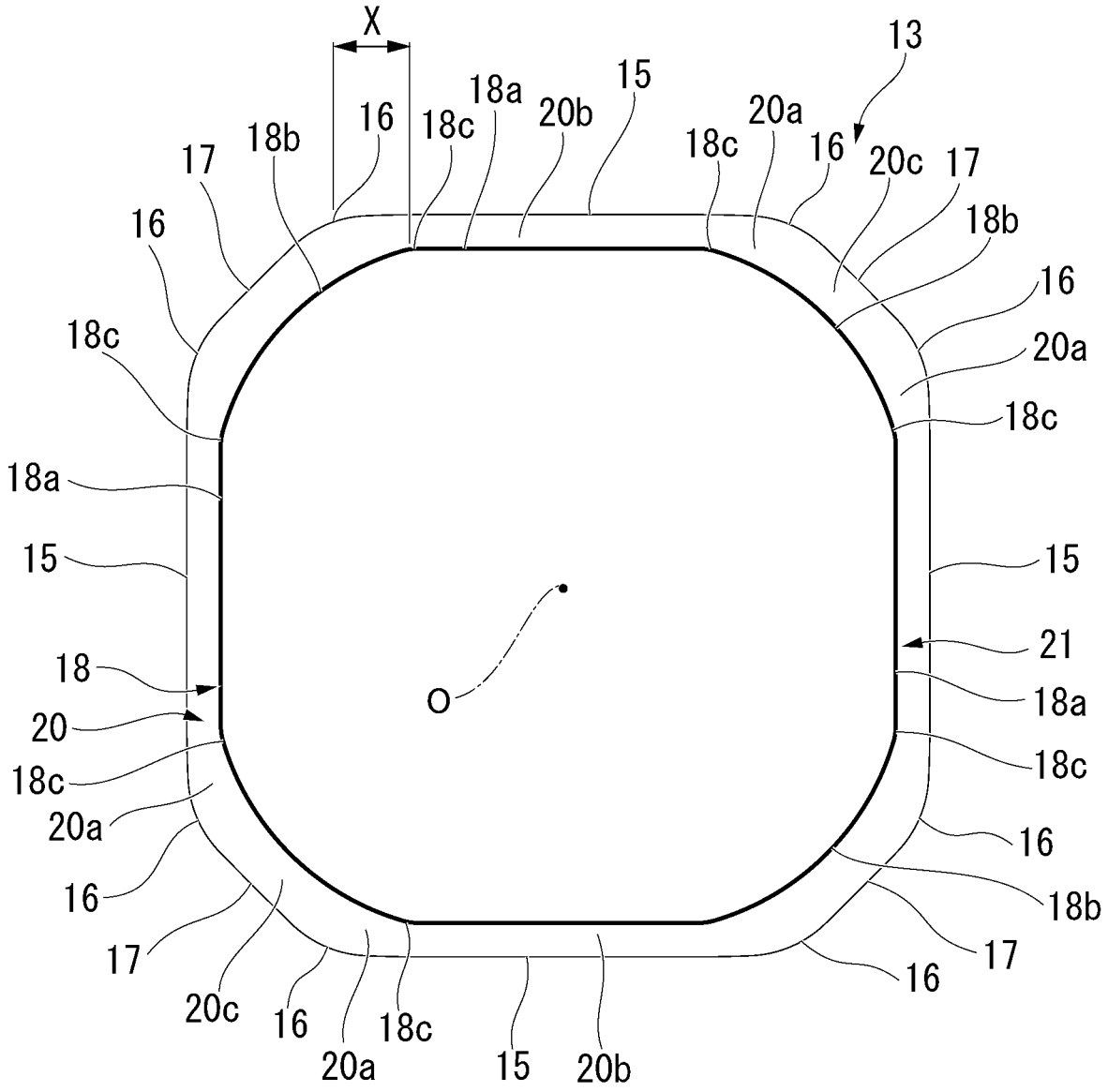
FIG. 2 is a cross-sectional view taken along line II-II of the square bottle shown in FIG. 1.

As shown in FIGS. 1 and 2, the body portion 13 is configured such that a plurality of panel surface portions 15 are provided to be continuous with corner surface portions 17 therebetween in the circumferential direction. Each of the corner surface portions 17 is formed in a strip shape having a width in the circumferential direction and a length in the vertical direction. The width of the corner surface portion 17 is smaller than a size in the circumferential direction of each of the panel surface portions 15. Outer peripheral surfaces of the panel surface portion 15 and the corner surface portion 17 extend substantially in a straight line in a cross-sectional view perpendicular to the bottle axis O. Further, the corner surface portion 17 may be an apex angle portion having no width in the circumferential direction.

The body portion 13 has substantially a square shape in a cross-sectional view perpendicular to the bottle axis O. In the shown example, the shoulder portion 12 and the bottom portion 14 also have substantially a square shape in a cross-sectional view perpendicular to the bottle axis O, similarly to the body portion 13. The panel surface portion 15 and the corner surface portion 17 are connected via a ridge line portion 16.

Here, having substantially a square shape means that the shape may not necessarily be an exact square shape. For example, even if each corners of the shape does not form normal angle, if the shape as a whole is substantially a square shape, it is substantially a square shape.

Also, configurations of the panel surface portion 15 and the corner surface portion 17 and so on are explained, it can be understood that explanations are applied to configurations of each of the plurality of the panel surface portions 15 and each of the plurality of the corner surface portions 17.

A peripheral groove 21 is formed on the body portion 13. A plurality of peripheral grooves 21 are formed on the body portion 13 at intervals in the vertical direction. The peripheral grooves 21 extend continuously over the entire circumference. One or more peripheral grooves 21 need only be formed on the body portion 13.

Each of the peripheral groove 21 is defined by a bottom surface 18 facing outward in the radial direction, an upper side surface 19 extending upward from an upper end of the bottom surface 18 outward in the radial direction, and a lower side surface 20 extending downward from a lower end of the bottom surface 18 outward in the radial direction.

A width of the bottom surface 18 is the same over the entire circumference. The bottom surface 18 has a shape that is formed such that a linear portion 18*a* positioned on the panel surface portion 15 and extending linearly and a curved portion 18*b* positioned on the corner surface portion 17 and having a convex curved shape outward in the radial direction are alternately provided to be continuous in the circumferential direction in a cross-sectional view perpendicular to the bottle axis O.

Central portions in the circumferential direction of the linear portion 18*a* and the panel surface portion 15 are coincident with each other. Central portions in the circumferential direction of the curved portion 18*b* and the corner surface portion 17 are coincident with each other. The linear portion 18*a* is positioned on the panel surface portion 15 over the entire length.

Both circumferential end portions of the curved portion 18*b* are positioned to protrude toward panel surface portions 15 adjacent to the corner surface portion 17 having the curved portion 18*b* positioned therein on both sides in the circumferential direction. Thereby, a connection portion 18*c* between the linear portion 18*a* and the curved portion 18*b* is positioned on the panel surface portion 15, and a circumferential position of the curved portion 18*b* and a circumferential position of the ridge line portion 16 overlap each other.

In the shown example, both circumferential end portions of the curved portion 18*b* are respectively positioned at the connection portions with the corner surface portion 17 on the respective panel surface portions 15 adjacent to the corner surface portion 17 having the curved portion 18*b* positioned therein on both sides in the circumferential direction. A circumferential distance X between the connection portion 18*c* of the bottom surface 18 and the ridge line portion 16 may be, for example, 2 mm or more.

Further, a configuration in which the curved portion 18*b* in its entire length is positioned in the corner surface portion 17 and the curved portion 18*b* does not protrude toward the panel surface portions 15 may also be employed.

Then, in the present embodiment, on the upper side surface 19 and the lower side surface 20 of the peripheral groove 21, radially outer end edges of portions (hereinafter referred to as end portions) 19*a* and 20*a* positioned at circumferential end portions of the panel surface portion 15 become further away in the vertical direction from the bottom surface 18 as they go toward an adjacent corner surface portion 17 when viewed from the outside in the radial direction.

Further, the radially outer end edge of the upper side surface 19 is coincident with an upper end edge of the upper side surface 19, and the radially outer end edge of the lower side surface 20 is coincident with a lower end edge of the lower side surface 20.

A groove width of the peripheral groove 21 at a portion positioned at the circumferential end portion of the panel surface portion 15 becomes larger toward an adjacent corner surface portion 17. The radially outer end edges of both the end portions 19*a* and 20*a* of the upper side surface 19 and the lower side surface 20 extend linearly when viewed from the outside in the radial direction.

Further, only a radially outer end edge of one of the end portions 19*a* and 20*a* of the upper side surface 19 and the lower side surface 20 may be caused to be further away in the vertical direction from the bottom surface 18 toward an adjacent corner surface portion 17 when viewed from the outside in the radial direction. The radially outer end edges of the end portions 19*a* and 20*a* of the upper side surface 19 and the lower side surface 20 may extend in a curved shape when viewed from the outside in the radial direction.

In the upper side surface 19 and the lower side surface 20 positioned on the panel surface portion 15, radially outer end edges of portions (hereinafter referred to as middle portions) 19*b* and 20*b* positioned between adjacent end portions 19*a* and between adjacent end portions 20*a* in the circumferential direction extend in a straight line in the circumferential direction when viewed from the outside in the radial direction. Circumferential lengths of the middle portions 19*b* and 20*b* are longer than circumferential lengths of the end portions 19*a* and 20*a*. The widths of the middle portions 19*b* and 20*b* are equal to the width of the bottom surface 18.

When viewed from the outside in the radial direction, the radially outer end edges of the end portions 19*a* and 20*a* of the upper side surface 19 and the lower side surface 20 become further away in the vertical direction from the bottom surface 18 as they go toward an adjacent corner surface portion 17 from the circumferential position at which the connection portion 18*c* between the linear portion 18*a* and the curved portion 18*b* is positioned. That is, a connection portion between the end portions 19*a* and 20*a* and the middle portions 19*b* and 20*b*, and the connection portion 18*c* between the linear portion 18*a* and the curved portion 18*b* are positioned at the same position in the circumferential direction.

Further, the circumferential positions of the connection portion between the end portions 19*a* and 20*a* and the middle portions 19*b* and 20*b*, and the connection portion 18*c* between the linear portion 18*a* and the curved portion 18*b* may be made different from each other. Only a radially outer end edge of one of the end portions 19*a* and 20*a* of the upper side surface 19 and the lower side surface 20 may be caused to be further away in the vertical direction from the bottom surface 18 toward an adjacent corner surface portion 17 from the circumferential position at which the connection portion 18*c* between the linear portion 18*a* and the curved portion 18*b* is positioned when viewed from the outside in the radial direction.

In the upper side surface 19 and the lower side surface 20, radially outer end edges of portions (hereinafter referred to as corner portions) 19*c* and 20*c* positioned in the corner surface portion 17 have a convex curved shape protruding in the vertical direction toward the bottom surface 18 to reduce the groove width of the peripheral groove 21 when viewed from the outside in the radial direction.

The radially outer end edge of the corner portion 19*c* of the upper side surface 19 is positioned above the radially outer end edge of the middle portion 19*b* of the upper side surface 19, and the radially outer end edge of the corner portion 20*c* of the lower side surface 20 is positioned below the radially outer end edge of the middle portion 20*b* of the lower side surface 20.

Further, only a radially outer end edge of one of the corner portions 19*c* and 20*c* of the upper side surface 19 and the lower side surface 20 may have a convex curved shape protruding in the vertical direction toward the bottom surface 18 to reduce the groove width of the peripheral groove 21 when viewed from the outside in the radial direction. The radially outer end edges of both the corner portions 19*c* and 20*c* of the upper side surface 19 and the lower side surface 20 may be caused to extend in a straight line in the circumferential direction when viewed from the outside in the radial direction.

Each of the corner portions 19*c* and 20*c* of the upper side surface 19 and the lower side surface 20 has a symmetrical shape with respect to a straight line extending in the vertical direction through a central portion in the circumferential direction of the corner surface portion 17 when viewed from the outside in the radial direction. Each of the upper side surface 19 and the lower side surface 20 positioned on the panel surface portion 15 has a symmetrical shape with respect to a straight line extending in the vertical direction through a central portion in the circumferential direction of the panel surface portion 15 when viewed from the outside in the radial direction.

The upper side surface 19 and the lower side surface 20 have a symmetrical shape with respect to a straight line extending in the circumferential direction through a central portion in the vertical direction of the peripheral groove 21 over the entire circumference when viewed from the outside in the radial direction.

As described above, according to the square bottle 1 according to the present embodiment, the radially outer end edges of the end portions 19*a* and 20*a* of the upper side surface 19 and the lower side surface 20 in the peripheral groove 21 become further away in the vertical direction from the bottom surface 18 as they go toward an adjacent corner surface portion 17 when viewed from the outside in the radial direction, and thereby a surface area of the peripheral groove 21 at a portion positioned at the circumferential end portion of the panel surface portion 15 is extended in the vertical direction.

Accordingly, even when a stress applied to the ridge line portion 16 between the panel surface portion 15 and the corner surface portion 17, on which a stress is particularly easily concentrated, is transferred to the peripheral groove 21 at the time of pressure reduction in the square bottle 1, the stress is alleviated by the end portions 19*a* and 20*a* of the upper side surface 19 and the lower side surface 20, and thereby improper deformation of the body portion 13 can be inhibited.

Since both the circumferential end portions of the curved portion 18*b* of the bottom surface 18 are positioned to protrude toward panel surface portions 15 adjacent to the corner surface portion 17 having the curved portion 18*b* positioned therein on both sides in the circumferential direction, the circumferential position of the curved portion 18*b* and the circumferential position of the ridge line portion 16 overlap each other. Thereby, even when a stress applied to the ridge line portion 16 is transferred from an outer side in the vertical direction to the bottom surface 18 of the peripheral groove 21 at the time of pressure reduction in the square bottle 1, the stress is alleviated by the curved portion 18*b*. Therefore, improper deformation of the body portion 13 can be reliably inhibited.

When viewed from the outside in the radial direction, the radially outer end edges of the end portions 19*a* and 20*a* of the upper side surface 19 and the lower side surface 20 in the peripheral groove 21 become further away in the vertical direction from the bottom surface 18 as they go toward an adjacent corner surface portion 17 from the circumferential position at which the connection portion 18*c* of the bottom surface 18 is positioned. Therefore, the portion of the peripheral groove 21 positioned at the circumferential end portion of the panel surface portion 15 is defined by the end portions 19*a* and 20*a* of the upper side surface 19 and the lower side surface 20, and the curved portion 18*b* of the bottom surface 18.

Therefore, a stress transferred from the ridge line portion 16 at the time of pressure reduction in the square bottle 1 can be alleviated in almost the entire region of the portion of the peripheral groove 21 positioned at the circumferential end portion of the panel surface portion 15. Therefore, improper deformation of the body portion 13 can be reliably inhibited.

The radially outer end edges of the corner portions 19*c* and 20*c* of the upper side surface 19 and the lower side surface 20 in the peripheral groove 21 have a convex curved shape protruding in the vertical direction toward the bottom surface 18 when viewed from the outside in the radial direction. Therefore, the radially outer end edges of the corner portions 19*c* and 20*c* and the end portions 19*a* and 20*a* can be smoothly connected in the circumferential direction, respectively. Therefore, a stress can be inhibited from being concentrated on the connection portion between the ridge line portion 16 and the peripheral groove 21 at the time of pressure reduction in the square bottle 1.

Figure 3:
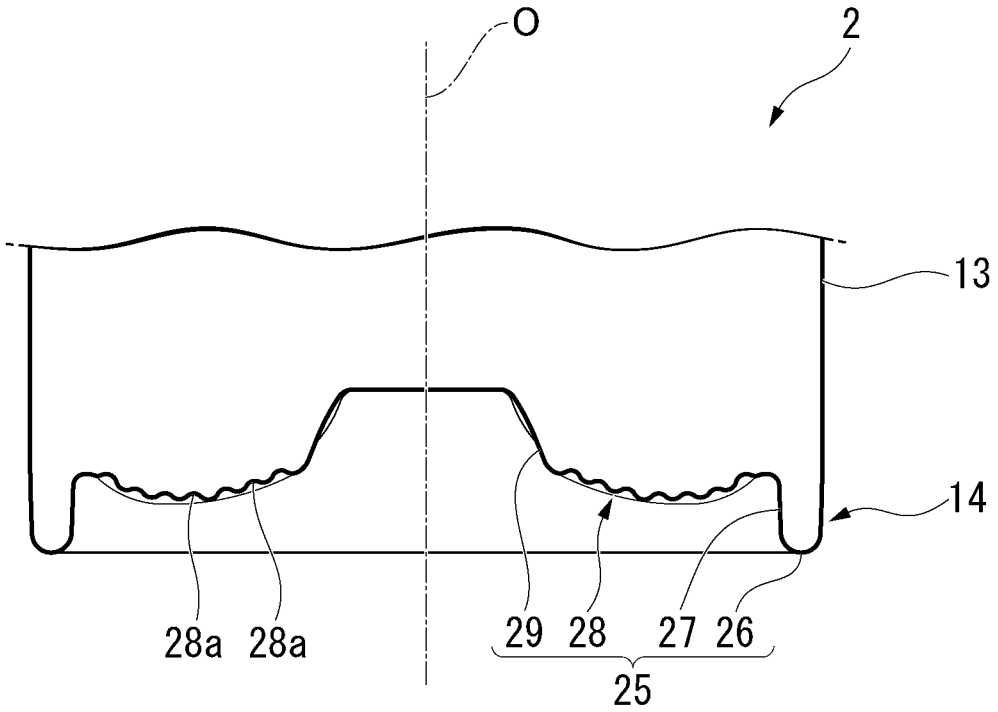
FIG. 3 is a longitudinal sectional view of a bottom portion of a square bottle shown as a second embodiment according to the present invention.
Figure 4:
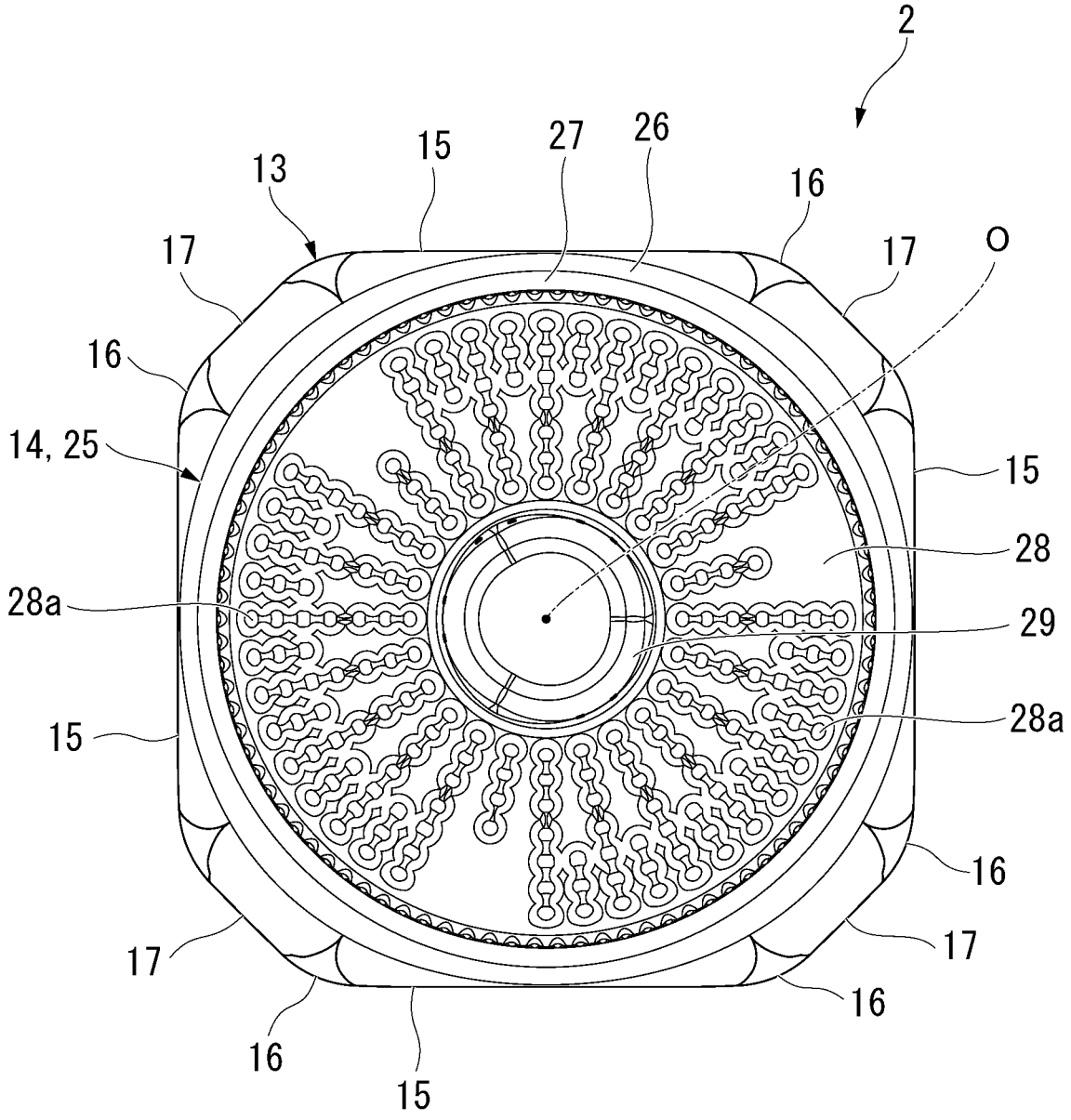
FIG. 4 is a bottom view of the square bottle shown in FIG. 3.

Next, a square bottle 2 according to a second embodiment of the present invention will be described with reference to FIGS. 3 and 4.

In the second embodiment, components the same as those in the first embodiment are denoted by the same references, description thereof will be omitted, and only different points will be described.

A bottom wall portion 25 of a bottom portion 14 includes an annular ground contact portion 26 positioned at an outer circumferential edge portion, a cylindrical upright circumferential wall portion 27 which is continuous with the ground contact portion 26 from a radially inward side and extends upward, an annular movable wall portion 28 extending radially inward from an upper end portion of the upright circumferential wall portion 27 and provided to be movable upward about a connection portion with the upright circumferential wall portion 27, and a concavely recessed portion 29 having a topped cylindrical shape extending upward from a radially inner end portion of the movable wall portion 28.

The ground contact portion 26 has a circular shape that is disposed coaxially with a bottle axis O when viewed in a vertical direction. The ground contact portion 26 is provided to be inscribed in a panel surface portion 15 when viewed in the vertical direction.

At the time of pressure reduction in the square bottle 2, the movable wall portion 28 moves upward about the connection portion with the upright circumferential wall portion 27. The movable wall portion 28 is formed in a curved surface shape which is convex downward. A rib 28*a* is formed on the movable wall portion 28. A plurality of ribs 28*a* are disposed at intervals in the radial direction, and a plurality of ribs 28*a* are disposed at intervals in the circumferential direction.

The ribs 28*a* may not be formed on the movable wall portion 28. A shape of the ground contact portion 26 in a plan view when viewed in the vertical direction may be an angular shape such as a rectangular shape.

As described above, according to the square bottle 2 according to the present embodiment, since the bottom wall portion 25 of the bottom portion 14 includes the upright circumferential wall portion 27 and the movable wall portion 28, at the time of pressure reduction in the square bottle 2, the movable wall portion 28 is moved upward about the connection portion with the upright circumferential wall portion 27 such that a decrease in internal pressure of the square bottle 2 can be inhibited, and thereby an improper deformation of the body portion 13 can be reliably inhibited.

Since the ground contact portion 26 has a circular shape disposed coaxially with the bottle axis O when viewed in the vertical direction, a distance between the bottle axis O and the ground contact portion 26 is the same over the entire circumference, and thus the ground contact portion 26 can be formed with high accuracy over the entire circumference when the square bottle 2 is formed by blow molding.

The present invention is not limited to the embodiments described above and can be modified appropriately within a scope not deviating from the scope of the present invention as claimed.

For example, in the above-described embodiment, each of the corner portions 19*c* and 20*c* of the upper side surface 19 and the lower side surface 20 has a symmetrical shape with respect to a straight line extending in the vertical direction through a central portion in the circumferential direction of the corner surface portion 17 when viewed from the outside in the radial direction, but a configuration having an asymmetric shape may be employed.

Each of the upper side surface 19 and the lower side surface 20 positioned on the panel surface portion 15 may have an asymmetric shape with respect to a straight line extending in the vertical direction through a central portion in the circumferential direction of the panel surface portion 15 when viewed from the outside in the radial direction.

The upper side surface 19 and the lower side surface 20 may have an asymmetric shape with respect to a straight line extending in the circumferential direction through a central portion in the vertical direction of the peripheral groove 21 when viewed from the outside in the radial direction.

Also, in the above-described embodiment, although a shape of each of the shoulder portion 12, the body portion 13 and the bottom portion 14 in a cross-sectional view perpendicular to the bottle axis O is square, the present invention is not limited thereto and may be changed as appropriate such as, for example, to a triangular shape, a rectangular shape, or a pentagonal shape.

Also, a synthetic resin material forming the square bottles 1 and 2 may be changed as appropriate such as, for example, to polyethylene terephthalate, polyethylene naphthalate, amorphous polyester, and the like, or a blended material thereof.

Further, the square bottles 1 and 2 are not limited to a single layer structure and may be a laminated structure having an intermediate layer. As the intermediate layer, a layer made of a resin material having gas barrier properties, a layer made of a recycled material, a layer made of a resin material having oxygen absorbing ability, or the like can be exemplified.

In addition, the components in the above-described embodiments can be appropriately replaced with well-known components without departing from the scope of the present invention as claimed, and furthermore, the above-described modified examples may be appropriately combined.

What is claimed is:

1. A square bottle comprising a mouth portion, a shoulder portion, a body portion, and a bottom portion which are provided to be continuous in this order from a top to a bottom in a bottle axis direction, wherein a plurality of panel surface portions are provided in the body portion to be continuous with corner surface portions therebetween in a circumferential direction around a bottle axis and a peripheral groove is formed in the body portion, the peripheral groove is defined by:

a bottom surface facing outward in a radial direction of the bottle intersecting the bottle axis;

an upper side surface extending upward from an upper end of the bottom surface outward in the radial direction; and a lower side surface extending downward from a lower end of the bottom surface outward in the radial direction, and, in at least one of the upper side surface and the lower side surface, a radially outer end edge of a portion positioned at a circumferential end portion of each of the plurality of panel surface portions extends toward each adjacent corner surface portion such that the radially outer end edge is further away in the bottle axis direction from the bottom surface when viewed from the outside in the radial direction, each corner surface portion is formed in a strip shape having a width in the circumferential direction and a length in the bottle axis direction, and in at least one of the upper side surface and the lower side surface, a radially outer end edge of a portion positioned in each corner surface portion has a convex curved shape protruding in the bottle axis direction toward the bottom surface to reduce a groove width of the peripheral groove when viewed from the outside in the radial direction.

2. The square bottle according to claim 1, wherein the bottom surface has a shape that is formed such that a linear portion positioned on each of the plurality of panel surface portions and extending linearly and a curved portion positioned in each corner surface portion and having a convex curved shape outward in the radial direction are alternately provided to be continuous in the circumferential direction in a cross-sectional view perpendicular to the bottle axis, and both circumferential end portions of the curved portion are positioned to protrude toward each of the plurality of panel surface portions adjacent to each corner surface portion having the curved portion positioned therein on both sides in the circumferential direction.

3. The square bottle according to claim 2, wherein, in at least one of the upper side surface and the lower side surface, the radially outer end edge of the portion positioned at the circumferential end portion of each of the plurality of panel surface portions extends toward each adjacent corner surface portion from a circumferential position at which a connection portion between the linear portion and the curved portion is positioned such that the radially outer end edge is further away in the bottle axis direction from the bottom surface when viewed from the outside in the radial direction.

4. The square bottle according to claim 3, wherein a bottom wall portion of the bottom portion includes:

an annular ground contact portion positioned at an outer circumferential edge portion, a cylindrical upright circumferential wall portion which is continuous with the ground contact portion from a radially inward side and extends upward, and an annular movable wall portion extending radially inward from an upper end portion of the upright circumferential wall portion and provided to be movable upward about a connection portion with the upright circumferential wall portion.

5. The square bottle according to claim 2, wherein a bottom wall portion of the bottom portion includes:

an annular ground contact portion positioned at an outer circumferential edge portion, a cylindrical upright circumferential wall portion which is continuous with the ground contact portion from a radially inward side and extends upward, and an annular movable wall portion extending radially inward from an upper end portion of the upright circumferential wall portion and provided to be movable upward about a connection portion with the upright circumferential wall portion.

6. The square bottle according to claim 1, wherein a bottom wall portion of the bottom portion includes:

an annular ground contact portion positioned at an outer circumferential edge portion, a cylindrical upright circumferential wall portion which is continuous with the ground contact portion from a radially inward side thereof and extends upward, and an annular movable wall portion extending radially inward from an upper end portion of the upright circumferential wall portion and provided to be movable upward about a connection portion with the upright circumferential wall portion.

* * * * *